US006357377B1

(12) United States Patent
Santelli, Jr.

(10) Patent No.: US 6,357,377 B1
(45) Date of Patent: Mar. 19, 2002

(54) COLLAPSIBLE IMPACT ABSORBING DEVICE

(76) Inventor: Albert Santelli, Jr., 123 N. Mountain Ave., Bound Brook, NJ (US) 08805

( * ) Notice: Subject to any disclaimer, the term of this patent is extended or adjusted under 35 U.S.C. 154(b) by 0 days.

(21) Appl. No.: 09/564,275

(22) Filed: May 4, 2000

(51) Int. Cl.[7] ..... B63B 59/02
(52) U.S. Cl. ..... 114/219
(58) Field of Search ..... 114/219; 405/212, 405/213

(56) References Cited

U.S. PATENT DOCUMENTS

| | | | | |
|---|---|---|---|---|
| 1,361,902 A | | 12/1920 | Porteous | |
| 3,321,200 A | | 5/1967 | Polhemus et al. | |
| 3,498,252 A | | 3/1970 | Peacock | |
| 3,664,653 A | | 5/1972 | Walker | |
| 3,863,589 A | | 2/1975 | Guieene et al. | |
| 3,988,997 A | * | 11/1976 | Fenton | 114/219 |
| 3,997,150 A | | 12/1976 | Hanson et al. | |
| 4,235,427 A | | 11/1980 | Bialobrzeski | |
| 4,841,893 A | | 6/1989 | Ellison | |
| 5,685,752 A | * | 11/1997 | Fulton, Jr. | 441/90 |

* cited by examiner

*Primary Examiner*—Ed Swinehart
(74) *Attorney, Agent, or Firm*—Paul A. Schwarz; Duane, Morris & Heckscher

(57) ABSTRACT

An impact absorbing device which provides impact protection for boats and personal watercraft, having an elongated collapsible molded plastic body including a plurality of pleats that fold and stack against one another, and a flexible plastic attachment member connected to the body that permits the device to be suspended from an associated boat, watercraft or docking structure. The collapsible body of the device permits it to be collapsed down into a compact configuration that consumes less space storage space in a boat or watercraft.

14 Claims, 3 Drawing Sheets

COLLAPSIBLE IMPACT ABSORBING DEVICE

FIELD OF THE INVENTION

This invention relates to an impact absorbing device for boats and personal watercraft that can be collapsed down into a compact configuration for convenient storage in a boat or watercraft.

BACKGROUND OF THE INVENTION

Impact absorbing devices which protect the outer hull of a boat from impacts are commonly known as boat fenders. Boat fenders are typically suspended between the boat and the dock to which the boat is to be tied off, or between boats which are rafted together. Boat fenders can be suspended by hanging them from either the boat or by mounting them to the sides of the dock. Boat fenders suspended from a boat are typically raised and placed in the boat during operation thereof.

The prior art is replete with various types of boat fender designs. Most of these designs are either resilient or inflatable. Resilient boat fender designs take up a great deal of space when stored inside a boat. This can be a significant problem in small boats.

Inflatable boat fender designs usually take up less space than resilient boat fenders because they are deflatable. However, these boat fenders must be re-inflated when the boat is docked or rafted, which is inconvenient and time consuming.

Accordingly, an impact absorbing device for boats and personal watercraft is needed which is convenient to use and which consumes less space storage space in a boat or watercraft.

SUMMARY OF THE INVENTION

An impact absorbing device which provides impact protection for boats and personal watercraft, the device comprising an elongated collapsible body, and an attachment member connected to the body, the attachment member for suspending the device from an associated boat, watercraft or docking structure. The collapsible body of the fender permits it to be collapsed down into a compact configuration that consumes less storage space in a boat.

BRIEF DESCRIPTION OF THE DRAWINGS

The advantages, nature, and various additional features of the invention will appear more fully upon cosideration of the illustrative embodiments now to be described in detail in connection with accompanying drawings wherein.

It should be understood that the drawings are for purposes of illustrating the concepts of the invention and are not to scale.

DETAILED DESCRIPTION OF THE INVENTION

Figure 1:
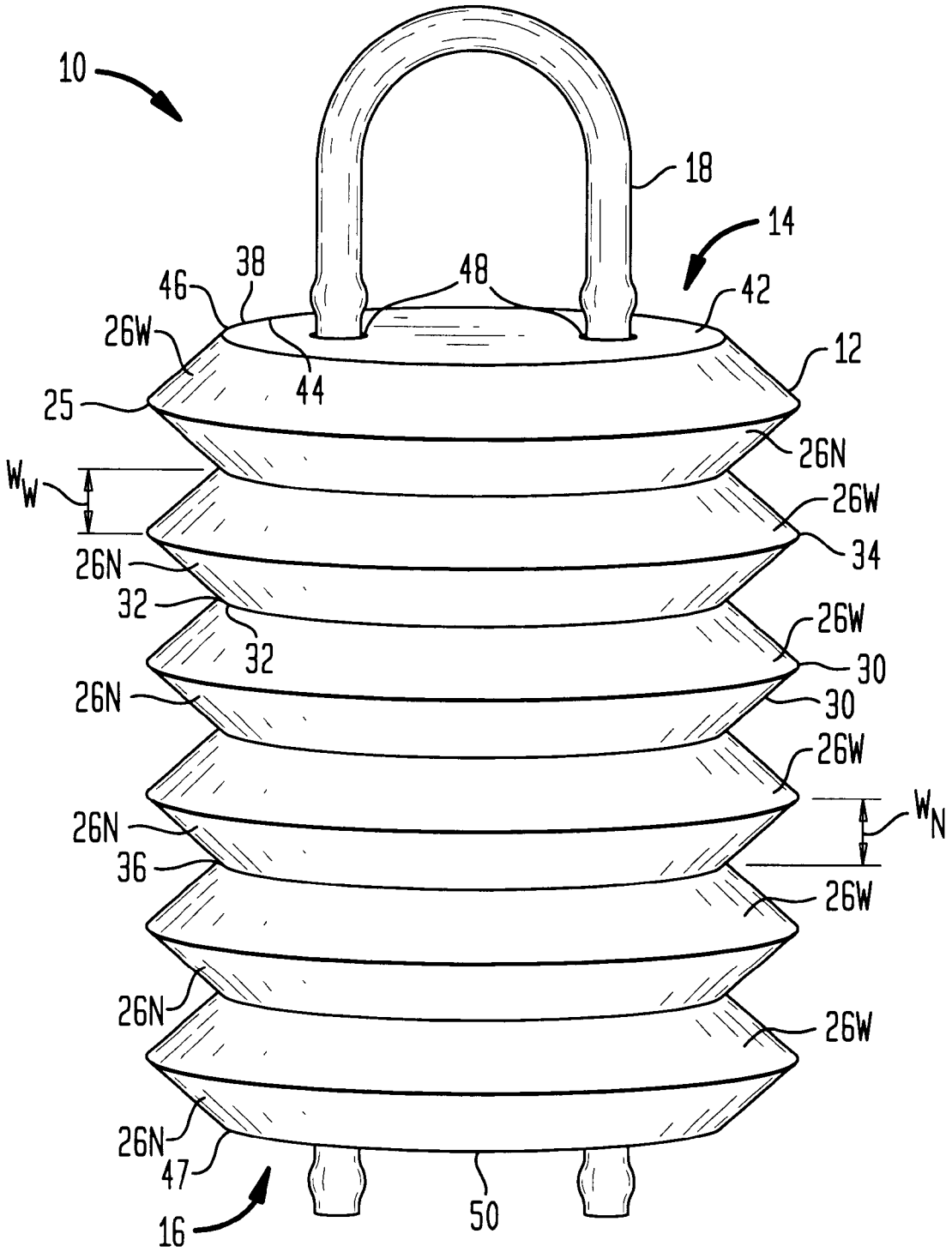
FIG. 1 is a perspective illustration of an impact absorbing device according to an embodiment of the invention.

FIG. 1 illustrates an impact absorbing device 10 according to an embodiment of the invention for boats and personal watercraft. The device 10 generally includes an elongated collapsible body 12 having a closed base end 14, an opposing closed top end 16, and an attachment member 18 which extends through the body 12 out the top and base ends 14, 16 thereof.

Figure 2:
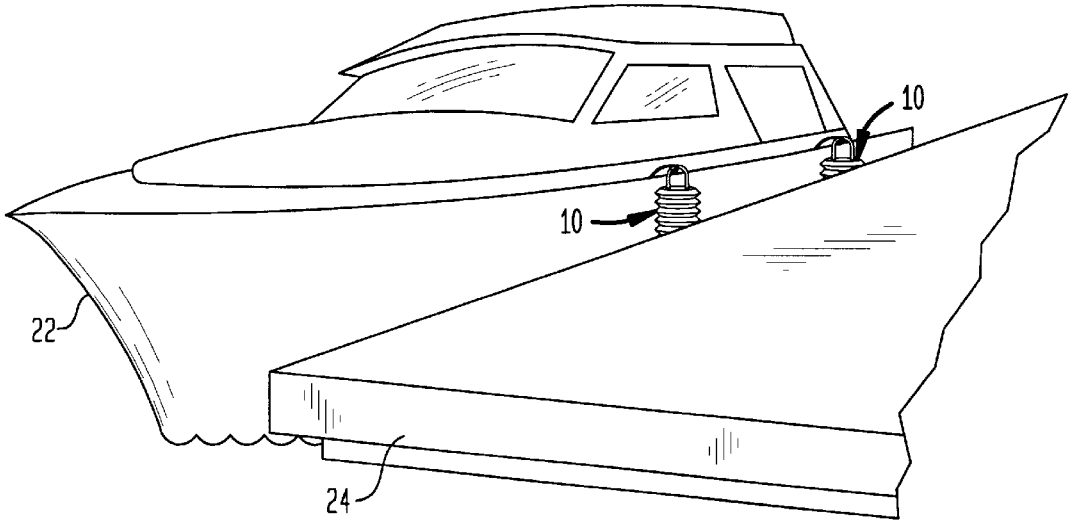
FIG. 2 is a diagrammatic illustration of the impact absorbing device of the invention in use.

As illustrated in FIG. 2, the attachment member 18 enables the device 10 to be suspended in a conventional manner adjacent the sides of a boat 22 or personal watercraft. The collapsible body 12 of the device 10 prevents the boat 22 from impacting or rubbing against the side of a dock 24, another boat (not shown), or other places where the boat 22 may pass through, and sustaining damage caused by the boat 22 rubbing thereagainst. The device 10 can also be suspended, via the attachment member 18, to the sides of the dock 24.

Figure 3:
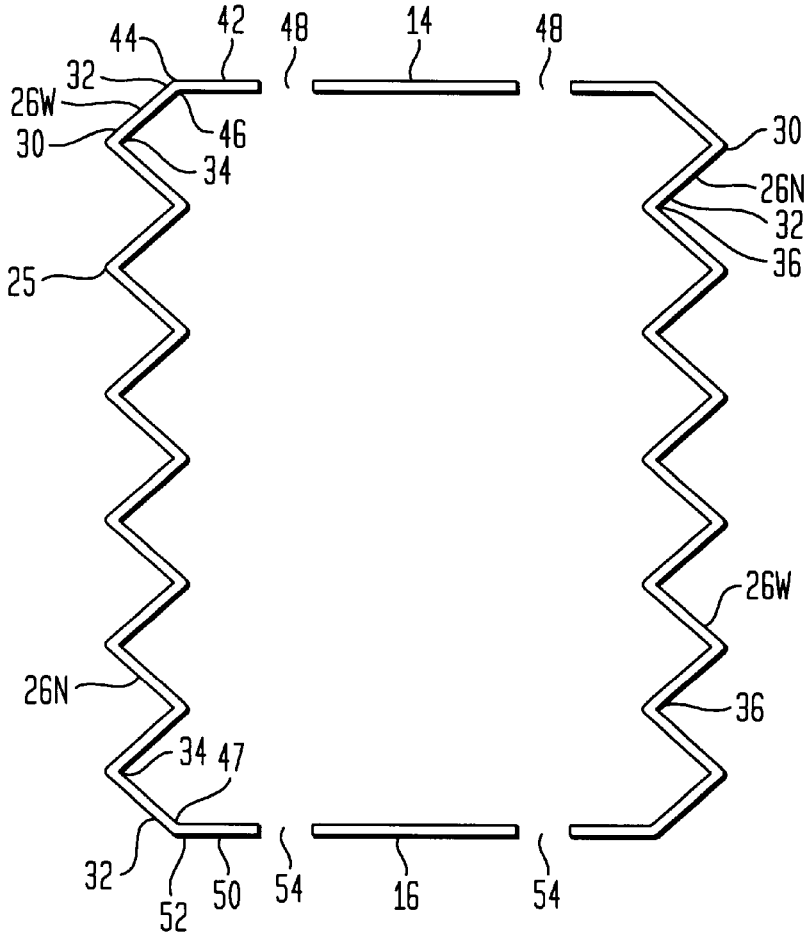
FIG. 3 is a sectional illustration of the device's collapsible body.

Referring again to FIG. 1, the device's collapsible body 12 is typically constructed as a generally cylindrical, pleated member 25 which is unitarily molded as a single unit from plastic. The pleated member 25 comprises alternating ring-shaped wide and narrow pleats 26W, 26N. The wide pleats 26W have a width $W_W$ which is greater than the width $W_N$ of the narrow pleats 26N. As illustrated in FIG. 3, each pleat 26W, 26N includes an outer peripheral edge 30 and an inner peripheral edge 32. The outer peripheral edges 30 of adjacent pleats 26W, 26N are hingedly attached to each other by outer annular hinge elements 34. The inner peripheral edges 32 of adjacent pleats 26W, 26N are hingedly attached to each other by inner annular hinge elements 36. Each of the outer and inner hinge elements 34, 36 has a thickness that is typically equal to or slightly less than the thickness of one of the pleats 26W, 26N. The outer and inner hinge elements 34, 36 allow the pleats 26W, 26N to snap-fold and stack against one another in a manner generally like that of a conventional corrugated drinking straw.

As can be seen in FIGS. 1 and 3, the wide pleat 26W adjacent the top end 14 of the body 12 is attached to a circular planar top wall 42 that closes off the top end 14 of the body 12. The top wall 42 has an outer circumferential edge 44 which is hingedly attached to the inner peripheral edge 32 of the uppermost wide pleat 26W by a unitarily formed top wall hinge element 46. The top wall hinge element 46 is typically identical in structure to the outer and inner hinge elements 34, 36. The top wall 42 further includes a pair of apertures 48 which allow an upper section of the attachment member 18 to extend therethrough.

The narrow pleat 26N adjacent the base end 16 of the body 12 is attached to a circular planar base wall 50 that closes off the base end 16 of the body 12. The base wall 50 has an outer circumferential edge 52 which is hingedly attached to the inner peripheral edge 32 of the lowermost narrow pleat 26N by a unitarily formed base wall hinge element 47. The base wall hinge element 47 is also typically identical in structure to the outer and inner hinge elements 34, 36. The base wall 50 further includes a pair of apertures 54 which allow the other end of the attachment member 18 to extend therethrough.

The collapsible body 12 can be fabricated from a flexible plastic such as PVC, thermoplastic rubber, polyethylene or polyurethane, or any other suitable material and can be fabricated using conventional plastic molding methods such as rotary molding, blow molding, corracted extrusion or dip molding. Although the body 12 has been described above as a single-piece plastic molded member, it should be understood that the top and base walls 42, 50 can also be manufactured separately from the pleats 26W, 26N and assembled thereto using conventional plastic joining methods.

Figure 4:
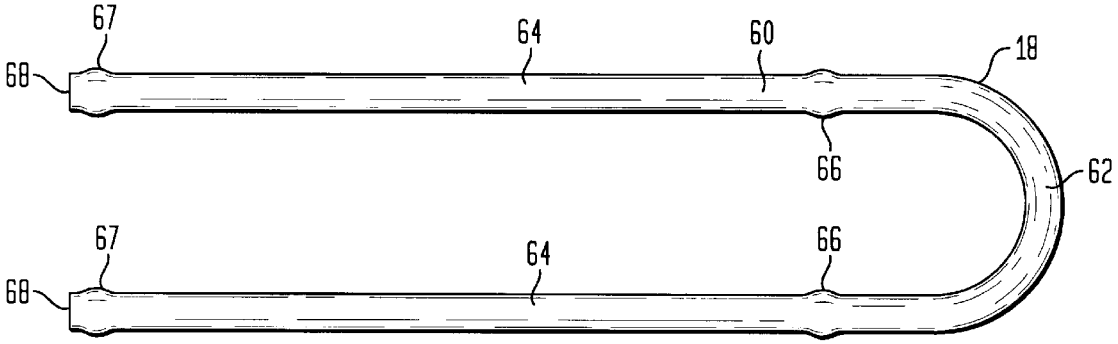
FIG. 4 is an elevational illustration of an attachment hook component of the device.

Referring to FIG. 4, the attachment member 18 is typically constructed as an inverted U-shape hook member 60. The hook 60 has an arcuate segment 62 coupling a pair of elongated posts 64. Bulges 66, 67 are molded into the attachment member posts 64 adjacent the post ends 68 and arcuate segment 62.

The attachment member 18 can be fabricated from a flexible plastic such as PVC, thermoplastic rubber, polyethylene or polyurethane, or any other suitable material using conventional plastic molding methods. In other embodiments of the invention, the attachment member 18 can be constructed from rope with tied knots forming the bulges.

Some embodiments of the invention, can include body 12 and attachment members 18 fabricated from thermoplastic rubbers with different durometers.

As illustrated in FIG. 1, the attachment member 18 is inserted through the collapsible body 12 such that the posts 64 of the member 18 extend through the apertures 48 in the top wall 42, and the apertures 54 in the base wall 50. The arcuate segment 62 of the member 18 is held above body top wall 42 by the bulges 66 molded into the attachment member posts 64 adjacent the arcuate segment 62 thereof. The bulges 67 adjacent the post ends 68 prevent them from being withdrawn back through the apertures 54 in the base wall 50 of the collapsible body 12.

Figure 5:
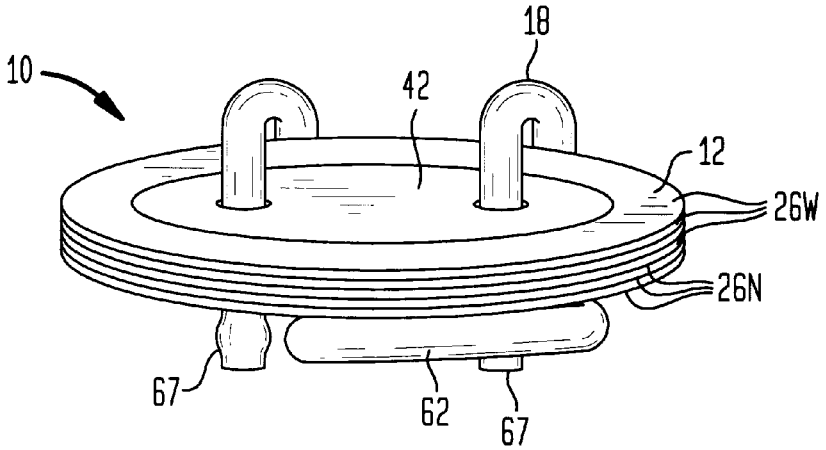
FIG. 5 is a perspective illustration of the device in a fully collapsed position.

As illustrated in FIG. 5, the inventive impact absorbing device 10 of the invention can be advantageously collapsed down into a flat, compact configuration that consumes less space for convenient storage in boats or watercraft. This can be easily accomplished by simply pressing the top and base walls 42, 50 of the collapsible body 12 together. This causes the pleats 26W, 26N of the body 12 to snap-fold and stack flat against one another, thus, collapsing or flattening the body 12. The flexible nature of the attachment member 18 allows the arcuate section 62 to be wrapped around the collapsed body 12 and snapped over one of the post ends 68.

The device 10 can be converted back to its original uncollapsed configuration by unsnapping the arcuate section 62 from the post end 18 and grasping the top and base walls 42, 50 and pulling them apart to unfold the pleats 26W, 26N of the collapsible body 12. As the pleats unfold, they snap into the unfolded position. Once unfolded, the collapsible body 12 will maintain the uncollapsed configuration until compressive pressure is applied at the top and base walls 42, 50 thereof as described above.

While the foregoing invention has been described with reference to the above embodiments, various modifications and changes can be made without departing from the spirit of the invention. Accordingly, all such modifications and changes are considered to be within the scope of the appended claims.

What is claimed is:

1. An impact absorbing device comprising:

an elongated collapsible body; and an attachment member connected to the body, for suspending the device;

wherein the body includes a closed base end and an opposing closed top end, the attachment member extending through the body and out an end thereof.

2. The device according to claim 1, wherein the body includes a plurality of pleats that can be folded and stacked against one another.

3. The device according to claim 1, wherein the body is made from plastic.

4. The device according to claim 1, wherein the body is a single-piece plastic molded member.

5. The device according to claim 1, wherein the attachment member is made from a flexible plastic.

6. An impact absorbing device which provides impact protection for boats and watercraft, the device comprising:

an elongated collapsible body including a plurality of hingedly attached pleats that can be folded and stacked against one another, the body being a single-piece plastic molded member; and an attachment member connected to the body for suspending the device from an associated boat, watercraft or docking structure;

wherein the body further includes a closed base end and an opposing closed top end, the attachment member extending through the body and out an end thereof.

7. The device according to claim 6, wherein the attachment member is made from a flexible plastic.

8. The device according to claim 6, wherein the attachment member is made from rope.

9. An impact absorbing device which provides impact protection for boats and watercraft, the device comprising:

an elongated collapsible body; and an attachment member connected to the body, the attachment member having a hook-shaped segment that permits the device to be suspended from an associated boat, watercraft or docking structure;

wherein the body includes a closed base end and an opposing closed top end, the attachment member extending through the body and out an end thereof.

10. The device according to claim 9, wherein the body includes a plurality of pleats that can be folded and stacked against one another.

11. The device according to claim 9, wherein the body is made from plastic.

12. The device according to claim 9, wherein the body is a single-piece plastic molded member.

13. The device according to claim 9, wherein the attachment member is made from a flexible plastic.

14. The device according to claim 9, wherein the attachment member is made from rope.

* * * * *